US009897270B2

(12) United States Patent
Wu

(10) Patent No.: US 9,897,270 B2
(45) Date of Patent: Feb. 20, 2018

(54) METHOD AND DEVICE FOR REALIZING ELECTRIC CANDLE FLAME WITH DYNAMIC VISUAL EFFECT

(71) Applicant: SHENZHEN XINGRISHENG INDUSTRIAL CO., LTD, Shenzhen, Guangdong province (CN)

(72) Inventor: Wang Wu, Shenzhen (CN)

(73) Assignee: SHENZHEN XINGRISHENG INDUSTRIAL CO., LTD. (CN)

( * ) Notice: Subject to any disclaimer, the term of this patent is extended or adjusted under 35 U.S.C. 154(b) by 13 days.

(21) Appl. No.: 15/114,817

(22) PCT Filed: Aug. 25, 2014

(86) PCT No.: PCT/CN2014/085078

§ 371 (c)(1),
(2) Date: Jul. 27, 2016

(87) PCT Pub. No.: WO2016/029334

PCT Pub. Date: Mar. 3, 2016

(65) Prior Publication Data

US 2017/0097131 A1 Apr. 6, 2017

(51) Int. Cl.

| | |
|---|---|
| ***F21V 33/00*** | (2006.01) |
| ***F21S 10/04*** | (2006.01) |
| ***F21S 6/00*** | (2006.01) |
| ***F04D 29/22*** | (2006.01) |
| ***F04D 29/28*** | (2006.01) |
| *F21Y 115/10* | (2016.01) |
| *B05B 17/06* | (2006.01) |

(52) U.S. Cl.
CPC ..... *F21S 10/046* (2013.01); *F04D 29/22* (2013.01); *F04D 29/28* (2013.01); *F21S 6/001* (2013.01); *B05B 17/06* (2013.01); *F21Y 2115/10* (2016.08)

(58) Field of Classification Search
CPC ..... F21S 10/046; F21S 6/001; F21Y 2115/10; F04D 29/22; B05B 17/06
See application file for complete search history.

(56) References Cited

U.S. PATENT DOCUMENTS

2015/0338086 A1* 11/2015 Patton ..... F21V 33/0052 362/96
2016/0040844 A1* 2/2016 Patton ..... F21S 6/001 362/362
2016/0312969 A1* 10/2016 Patton ..... F21S 6/001

* cited by examiner

*Primary Examiner* — Ali Alavi
(74) *Attorney, Agent, or Firm* — PROI Intellectual Property US

(57) ABSTRACT

A method and device for realizing an electric candle flame with a dynamic visual effect. The device comprises a shell, an upper cover, a candle flame simulating object, an LED lamp, a pivot, a candle flame simulating object seat and a water stirring device. The seat is cylindrical and fixed at a center part of the upper cover, and the candle flame simulating object is vertically arranged in the seat in a swinging mode by the aid of the pivot. The LED lamp is arranged on the vertical wall of the seat and located at the lower front of one lateral plane of the candle flame simulating object, and LED lamp upwardly and obliquely emits light to said plane of the candle flame simulating object at an elevation angle. Water is filled in the lower part of the shell with the water stirring device is arranged therein.

14 Claims, 6 Drawing Sheets

METHOD AND DEVICE FOR REALIZING ELECTRIC CANDLE FLAME WITH DYNAMIC VISUAL EFFECT

CROSS REFERENCE TO RELATED APPLICATIONS

The present application is the US national stage of International Patent Application PCT/CN2014/085078 filed on Aug. 25, 2014.

TECHNICAL FIELD

The invention relates to combination of a lighting article and other articles, especially a device and system that can realize a dynamic visual effect due to the structural combination of the lighting article and the other articles; and particularly the invention relates to a method and device for an electric candle to simulate a flame and to realize dynamic visual effect.

BACKGROUND ART

In the modern society, people will always create and set off a romantic atmosphere by contrast with the aid of lighting candles on the occasion of a wedding ceremony, a friend's party, a birthday celebration, or a restaurant, a bar, a coffee house, etc. Nevertheless, traditional candles will not only have shorter combustion duration, pollute the environment and cause wasting of resources, but also will be harmful to people's health, moreover easily lead to a fire, therefore, simulation flames and simulation electric candle devices are more and more popular.

The simulation electric candle devices with prior art adopt the flame-shaped electric bulbs, so as to control lamp-light flickers thereof and to simulate dynamic flames. However, in this way, only the illumination of dynamic flames is simulated, moreover the appearance of the flames thereof is not real enough. The technical solution disclosed by the U.S. Pat. No. 8,070,319 B2 has preferably simulated the dynamic flames, with lively images. However, the pendulum-like candle flame simulating object thereof can only keep pushing by virtue of the electromagnetic force, applying it to the modeling of candle holder combined with water, the electromagnetic drive mechanism thereof requires complicated waterproof sealing design, and thus has greater technical difficulty and higher cost.

CONTENT OF THE INVENTION

The present invention aims to rectify the deficiencies of the prior art so as to provide a method and device of simple structure and low fabrication cost that enables the flame of an electric candle to render a dynamic visual effect.

The present invention provides a first method for an electric candle to realize visual effect of a dynamic flame, the first method comprising following steps:

A. installing a removable upper cover on at least one cylindrical shell with only one open end and with a tubular candle flame simulating object holder fixed at a central part of the upper cover, vertically mounting candle flame simulating object onto the candle flame simulating object holder by aid of a pivot, so as to allow the candle flame simulating object to swing vertically;

B. enabling the candle flame simulating object to pass through a central through hole of the upper cover, and extending a head part of the candle flame simulating object to outside the upper cover;

C. installing a Light Emitting Diode lamp on a vertical wall of the holder and located at the lower front of one lateral plane of the head part of the candle flame simulating object, such that the light rays of the Light Emitting Diode lamp upwardly and obliquely emits to said lateral plane of the head part of the candle flame simulating object by an elevation angle β;

D. arranging a water stirring device at a lower part of the shell, and injecting water into the shell to immerse a tail end of a lower part of the candle flame simulating object.

lighting up the Light Emitting Diode lamp, and starting the water stirring device, to allow a stream of water to shoot out from a water outlet of the water stirring device and to generate fluctuations on the water filled in the shell so as to enable the candle flame simulating object to swing back and forth and the light of the Light Emitting Diode lamp to be projected to the head part of the candle flame simulating object, resulting in the visual effect of a dynamic flame.

Preferably, with respect to the first method, when implementing Step C, the elevation angle β of the light emitted from the LED lamp may be within a range of $20° \leq \beta \leq 70°$.

Preferably, with respect to the first method, when implementing Step A, the candle flame simulating device may be flat, with the head part thereof having a flame-like form and the lower part thereof being thicker than an upper part thereof, so as to enable the center of gravity of the candle flame simulating object to be low. A through hole may be provided in the middle of the candle flame simulating object, the through-hole being penetrated by the pivot. The candle flame simulating object may be in an upright position and can swing due to the lower part thereof being heavier than the upper part thereof.

The present invention further provides a second method for an electric candle to realize visual effect of a dynamic flame, the second method comprising the following steps:

A. installing a removable upper cover on at least one cylindrical shell with only one open end and with a tubular holder fixed at a central part of the upper cover, the holder being for holding a candle flame simulating object; vertically mounting a candle flame simulating object onto the holder by aid of a pivot so as to allow the candle flame simulating object to swing vertically;

B. enabling the candle flame simulating object to pass through a central through hole of the upper cover, and extending a head part of the candle flame simulating object to outside the upper cover;

C. installing a Light Emitting Diode lamp on a vertical wall of the holder and located at the lower front of one lateral plane of the head part of the candle flame simulating object such that the light of the Light Emitting Diode lamp upwardly and obliquely emits onto said lateral plane of the head part of the candle flame simulating object by an elevation angle β;

E. connecting a tail end of a lower part of the second candle flame simulating object with a horizontally positioned bottom platform coaxially and orthogonally, filling water into the shell without the water touching the bottom platform; arranging a water stirring device at or introducing an external water piping to the lower part of the shell; lighting up the LED lamp, starting the water stirring device to continuously provide a plurality of water drops onto the bottom platform so as to enable the candle flame simulating object to swing back and forth surrounding the pivot, resulting in the visual effect of a dynamic flame.

Preferably, with respect to second method, when implementing Step C, the elevation angle β of the light emitted from the LED lamp may be within a range of $20° \leq \beta \leq 70°$.

Preferably, with respect to second method, when implementing Step A, the candle flame simulating device may be flat, with the head part thereof having a flame-like form and the lower part thereof being thicker than an upper part thereof, so as to enable the center of gravity of the candle flame simulating object to be low. A through hole may be provided in the middle of the candle flame simulating object, the through-hole being penetrated by the pivot. The candle flame simulating object may be in an upright position and can swing due to the lower part thereof being heavier than the upper part thereof.

Preferably, with respect to the second method, since the tail end of the lower part of the candle flame simulating object may be coaxially and orthogonally connected with a horizontally positioned platform, although water can be filled into the shell, the water surface may not reach the platform. As the water flowing continuously onto the platform makes the candle flame simulating object out of balance, the candle flame is enabled to swing, resulting in the visual effect of a dynamic flame.

The present invention further provides a third method for an electric candle to realize visual effect of a dynamic flame, comprising the following steps:

A. installing a removable upper cover on at least one cylindrical shell with only one open end and with a tubular mounting rack fixed at a central part of the upper cover, the mounting rack being for mounting a candle flame simulating object, axially and rotatably mounting a candle flame simulating object onto the mounting rack by aid of a central through hole of a supporting seat arranged under the mounting rack, the support seat for supporting the candle flame simulating object;

B. enabling the candle flame simulating object to pass through a central through hole of the upper cover, and extending a head part of the candle flame simulating object to outside the upper cover;

C. installing a Light Emitting Diode lamp on a vertical wall of the mounting rack and located at the lower front of one lateral plane of the head part of the candle flame simulating object, enabling the light rays thereof to upwardly and obliquely emit onto the lateral plane of the head part of the candle flame simulating object with an elevation angle $\beta$;

D. installing an impeller in a shape of a water turbine rotor or an impeller comprising an assembly of multiple inclined plates, coaxially at the lower part in the middle of the candle flame simulating object, inserting a shaft provided at a tail part of the impeller into the central through hole of the supporting seat;

E. filling water into the shell, and arranging a submersible pump inside the shell, or introducing water from outside to axially from under a second central through hole of the supporting seat wherein the second central through hole has a larger diameter than the first central through hole of the supporting seat, and then discharging the water through a discharging channel at a lateral of the impeller;

starting the submersible pump or opening a valve to introduce the water from outside to let the water flow to impact the impeller from bottom up axially, enabling the candle flame simulating object to rotate, emitting the light of Light Emitting Diode onto the head part of the candle flame simulating object, resulting in the visual effect of a dynamic flame.

Preferably, with respect to the third method, when implementing Step C, the elevation angle $\beta$ of the light emitted from the LED lamp may be within a range of $20° \leq \beta \leq 70°$.

Preferably, with respect to the third method and in particular said Step A thereof, the central through hole may be a through hole of considerable axial length of an upper segment of the supporting seat, which is installed coaxially under the mounting rack (37); a tail part of the candle flame simulating object may be inserted into the through hole and is thus prevented from horizontal displacement.

The present invention further provides an electric candle device capable of realizing visual effect of a dynamic flame, comprising a shell, an upper cover and at least one candle flame simulating object. The shell has only one open end which an upper cover installed thereupon, the candle flame simulating object passing through a central through hole of the upper cover, with a head part of the candle flame simulating object extending to outside the upper cover; especially, the electric candle device further comprises a Light Emitting Diode lamp, a pivot, a holder for holding the candle flame simulating object and a water stirring device; the holder is tubular and is fixed to a central part of the upper cover, the candle flame simulating object is vertically positioned in the holder by virtue of the pivot; the Light Emitting Diode lamp is installed on a vertical wall of the holder and located at the lower front of one lateral plane of the head part of the candle flame simulating object such that the light rays of the Light Emitting Diode lamp upwardly and obliquely emits to said lateral plane of the head part of the candle flame simulating object by an elevation angle $\beta$; a water stirring device is arranged at a lower part of the shell; the shell can be filled with water.

The elevation angle of the light rays emitted from the Light Emitting Diode lamp can be within the range of $20° \leq \beta \leq 70°$.

The candle flame simulating object can be flat, with the upper part thereof having a flame-like form, which may be made of translucent material. The lower part of the candle flame simulating object can be thicker than the upper part, so as to enable the center of gravity of the candle flame simulating object to be low. A through hole may be provided in the middle of the candle flame simulating object, with the through hole penetrated by the pivot. Since the lower part of the candle flame simulating object is heavier than the upper part thereof, the candle flame simulating object can be in an upright position and can swing.

When the electric candle device is at work, first of all, water shall be provided into the shell, till the water immerses the lower part of the candle flame simulating object; lighting up the Light Emitting Diode lamp, starting the water stirring device, to allow a stream of water from the water outlet of the water stirring device to fluctuate the water surface; the fluctuating water surface will enable the candle flame simulating object to swing; the light of the Light Emitting Diode lamp will be projected on to the upper part of the candle flame simulating object, thus the candle flame simulating object will produce the visual effect of a dynamic flame.

The water stirring device may be a water pump, an air pump, an ultrasonic nebulizer, and a wave maker, just to name a few. The tail end of the lower part of the candle flame simulating object may also be directly immersed in the flowing water. The wave maker mentioned herein is usually used for making waves or surges artificially in the aquatic breeding box, which is commercially available.

The present invention further provides an electric candle device capable of realizing visual effect of a dynamic flame, said electric candle comprising a shell, an upper cover and at least one candle flame simulating object, wherein the shell has only one open end with an upper cover installed thereupon, the candle flame simulating object passing through a central through hole of the upper cover with a head part of the candle flame simulating object extending to outside of the upper cover; wherein the electric candle device further comprises a Light Emitting Diode lamp, a pivot, a holder for holding the candle flame simulating object and a water stirring device; wherein the holder is tubular and is fixed to a central part of the upper cover, the candle flame simulating object is vertically positioned in the holder in a swinging mode by aid of the pivot; wherein the LED lamp is installed on a vertical wall of the holder and located at the lower front of one lateral plane of the head part of the candle flame simulating object such that light of the LED lamp upwardly and obliquely emits onto said lateral plane of the head part of the candle flame simulating object by an elevation angle β; wherein a tail end of the candle flame simulating object is connected to a horizontally positioned bottom platform coaxially and orthogonally; wherein a water stirring device is provided at or an external water piping is introduced to the lower part of the shell; the water stirring device capable of continuously providing a plurality of water drops onto the bottom platform so as to enable the candle flame simulating object to swing back and forth surrounding the pivot.

With respect to the candle flame simulating object mentioned in the above paragraph, the water stirring device or an external water piping can be applied to enable water beads to be produced inside the shell of the electric candle and to attach to the outer cylindrical surface of the candle flame simulating object holder. The water beads slide down along the outer cylindrical surface to form water drops, which can continuously flow onto the platform of the second candle flame simulating object, enabling the second candle flame simulating object to swing back and forth surrounding the pivot, resulting in the visual effect of a dynamic flame. Meanwhile, the lower part of the shell is also filled with water, but the water surface may not reach the platform.

The present invention further provides an electric candle device capable of realizing visual effect of a dynamic flame, comprising a shell, an upper cover and at least one candle flame simulating object; the shell has only one open end with an upper cover installed thereupon; the candle flame simulating object passes through a central through hole of the upper cover, with a head part of the candle flame extending to outside of the upper cover; the electric candle device further comprises a Light Emitting Diode lamp, a mounting rack for mounting the candle flame simulating object, and a supporting seat, which is for supporting the candle flame simulating object, coaxially installed to the lower part of the mounting rack; the mounting rack is tubular and is fixed to a central part of the upper cover; the candle flame simulating object is axially and rotatably mounted onto the mounting rack through a central through hole of the supporting seat, which is arranged under the mounting rack; the Light Emitting Diode lamp is installed on a vertical wall of the holder and is located at the lower front of a lateral plane of the head part of the candle flame simulating object, such that the light rays thereof upwardly and obliquely emits onto said lateral plane of the head part of the candle flame simulating object by an elevation angle R.

The lower part of the shell is arranged with a submersible pump, and is filled with water; or, water can be introduced from outside to axially gush upward from under a central through hole of the supporting seat, wherein the second central through hole has a a larger diameter than that of the first central through hole of the supporting seat. The water may flow out from the discharge hole at the lateral of the impeller.

In comparison with the prior art, the present invention can provide at least the following beneficial effects: the device can achieve a good visual effect of a dynamic candle flame, and the device has a simple structure and can be manufactured with low cost.

Figure 1:
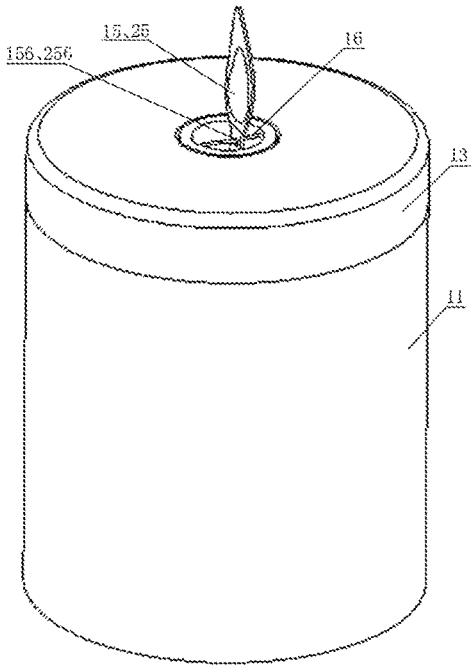
FIG. 1 shows a first figure of a first preferred embodiment of the invention, a method and device of enabling the flame of an electric candle to have dynamic visual effect, which is an axonometric projection diagram of an electric candle device with single candle head.
Figure 2:
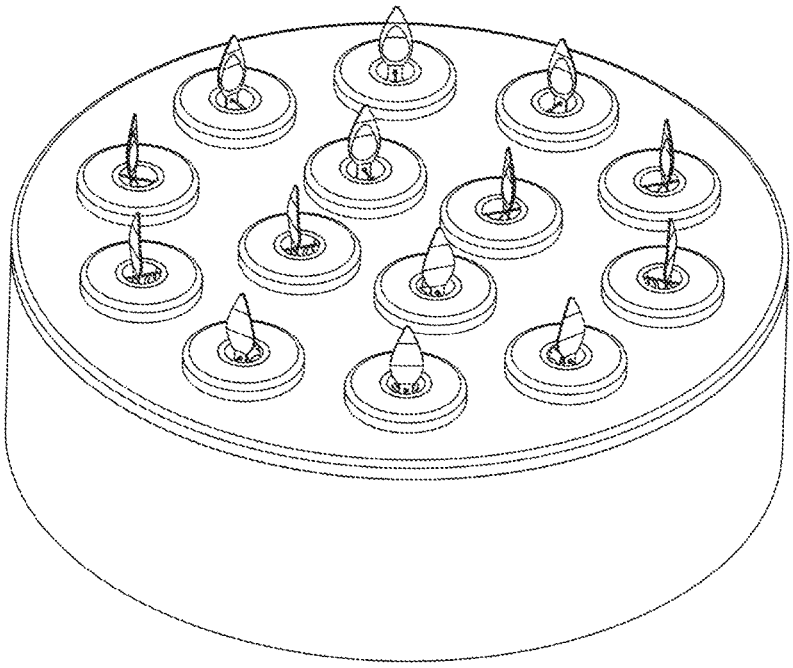
FIG. 2 shows a second figure of the first preferred embodiment, which is an axonometric projection diagram of an electric candle device with multiple candle heads.
Figure 3:
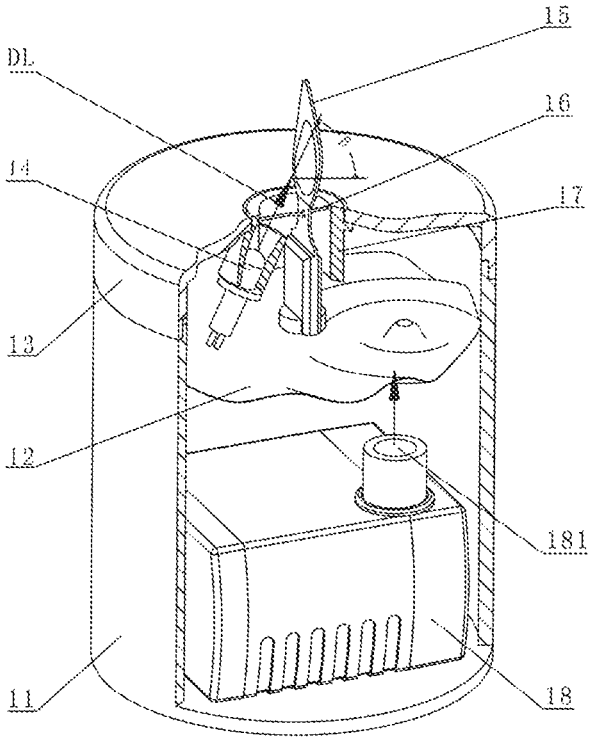
FIG. 3 shows a local section diagram of FIG. 1.
Figure 4:
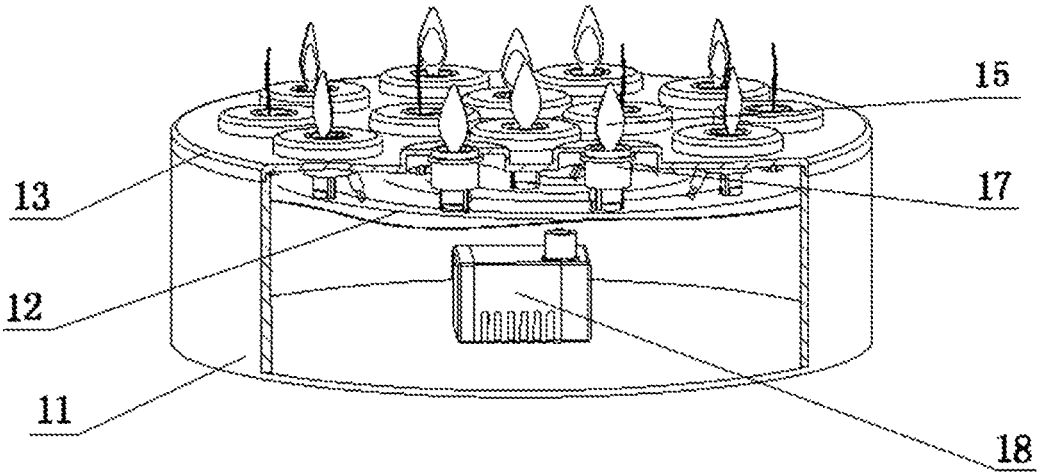
FIG. 4 shows a local section diagram of FIG. 2.

In the above figures: 11 is a shell, 12 is a fluctuating water surface, 13 is an upper cover, 14 is a Light Emitting Diode lamp; 15, 25 and 35 are respectively the first to the third candle flame simulating objects of the first to the third embodiment, 156 and 256 are respectively the through holes which are located at a lower part of the middle of the first or second candle flame simulating objects for being penetrated into the pivot 16; 251 is a platform of the second candle flame simulating object of the second embodiment, 16 is a pivot; 17 is a candle flame simulating object holder of the first and second embodiment, 37 is a candle flame simulating object mounting rack of the third embodiment, 39 is a candle flame simulating object supporting seat of the third embodiment; 18 is a water stirring device; 181 is a water outlet of the water stirring device, 171 are water beads attached to the outer cylindrical surface of the candle flame simulating object holder 17, 172 are water drops falling down; DR is an indication line of the direction of rotation of the third flame simulating object 35, DF is an indication line of the water flow direction, DL is an indication line of the direction where light rays are shot out from the Light Emitting Diode lamp 14.

DETAILED EMBODIMENTS

The following is further description of the invention with reference to the figures.

Referring to FIG. 1 to FIG. 6, the first and second preferred embodiments of the invention are illustrated, which comprise a method for an electric candle flame to realize dynamic visual effect, the method comprising the following steps:

A. installing a removable upper cover 13 on at least one cylindrical shell 11 with only one open end and with a tubular holder 17 fixed at a central part of the upper cover 13, the holder 17 being for holding a candle flame simulating object; a first or second candle flame simulating object 15 or 25 is mounted onto the holder 17 by aid of a pivot 16, resulting in that the candle flame simulating object 15 or 25 is able to swing in the vertically;

B. enabling the first candle flame simulating object 15 or the second candle flame simulating object 25 to pass through a central through hole of the upper cover 13; extending a head part of the first candle flame simulating object to outside of the upper cover 13;

C. installing a Light Emitting Diode lamp 14 on a vertical wall of the holder 17 and located at the lower front of one lateral plane of the head part of the first or second candle flame simulating object 15, 25, such that the light of the Light Emitting Diode lamp upwardly and obliquely emits to said lateral plane of the head part of the first or second candle flame simulating object 15, 25 by an elevation angle β;

D. arranging a water stirring device 18 at a lower part of the shell 11, and injecting water into the shell to immerse a tail end of a lower part of the first candle flame simulating object 15;

Lighting up the Light Emitting Diode lamp, and starting the water stirring device 18, to allow a stream of water to shoot up from the water outlet 181 of the water stirring device to cause the water surface to fluctuate, enabling the first candle flame simulating object 15 to swing back and forth; and the light of the Light Emitting Diode lamp will be projected onto the head part of the first candle flame simulating object 15, resulting in the visual effect of a dynamic flame.

When implementing Step C, the elevation angle s may be within the range of $20° \leq \beta \leq 70°$.

When implementing Step A, the first candle flame simulating object 15 or the second candle flame simulating object 25 involved may be flat, with the head part thereof having a flame-like form, any may be made of translucent material. The lower part of the first or second candle flame simulating object may be thicker than that to the head part of the first or second candle flame simulating object, so as to enable the center of gravity of the first or second candle flame simulating object 15 or 25 to be low. The lower part of the middle of the first candle flame simulating object 15 or the second candle flame simulating object 25 may be provided with a through hole 156 or 256, which is penetrated by the pivot 16. Since the lower part of the candle flame simulating object is heavier than the upper part, it is at an upright position and can swing back and forth.

The first and second embodiment of the invention further relates to an electric candle device with the visual effect of a dynamic flame. The electrical candle device comprises a shell 11, an upper cover 13 and at least one first candle flame simulating object 15 or one second candle flame simulating object 25. The shell 11 has only one open end upon which an upper cover 13 is installed. the first candle flame simulating object 15 or the second candle flame simulating object 25 passes through a central through hole of the upper cover 13, with a head part of the candle flame simulating object extending to out of the upper cover 13. The electrical candle device further comprises a Light Emitting Diode lamp 14, a pivot 16, a holder 17 for holding the first or second candle flame simulating object, and a water stirring device 18. The holder 17 is tubular and is fixed to a central part of the upper cover 13. The first candle flame simulating object 15 or the second candle flame simulating object 25 is mounted onto the holder 17 by aid of the pivot 16, resulting in that the first or second candle flame simulating object is able to swing in vertically. The Light Emitting Diode lamp 14 is installed on a vertical wall of the holder 17 and located at the lower front of one lateral plane of the first candle flame simulating object 15 or the second candle flame simulating object 25, such that the light thereof upwardly and obliquely emits to the lateral plane of the head part of the first candle flame simulating object 15 or the second candle flame simulating object 25 by an elevation angle β.

A water stirring device 18 may be arranged at a lower part of the shell 11, which can be filled with water to immerse a tail end of a lower part of the first candle flame simulating object 15.

The elevation angle may be within the range of $20° \leq \beta \leq 70°$. The first candle flame simulating object 15 or the second candle flame simulating object 25 is flat, with the head part thereof having a flame-like form and the lower part thereof being thicker than the head part thereof so as to enable the center of gravity of the candle flame simulating object to be low. The lower part of the middle part of the first candle flame mimic 15 or the second candle flame simulating object 25 may be respectively provided with a through hole 156 or 256, which is penetrated by the pivot 16. Since the lower part of the simulating object is heavier than the upper part, it is at an upright position and can swing.

With respect to the second candle flame simulating object, the tail end of the lower part of the second candle flame simulating object 25 is further coaxially and orthogonally connected to a horizontally positioned platform 251. Although a lower part of the shell may be filled with water, the water surface may not reach the platform 251.

The water stirring device 18 can be a water pump, an air pump, an ultrasonic nebulizer or a wave maker. The tail end of the lower part of the first candle flame simulating object 15 may be directly immersed in the flowing water. The wave maker mentioned herein is usually used for making waves or surges artificially in an aquatic breeding box, which is commercially available.

Figure 5:
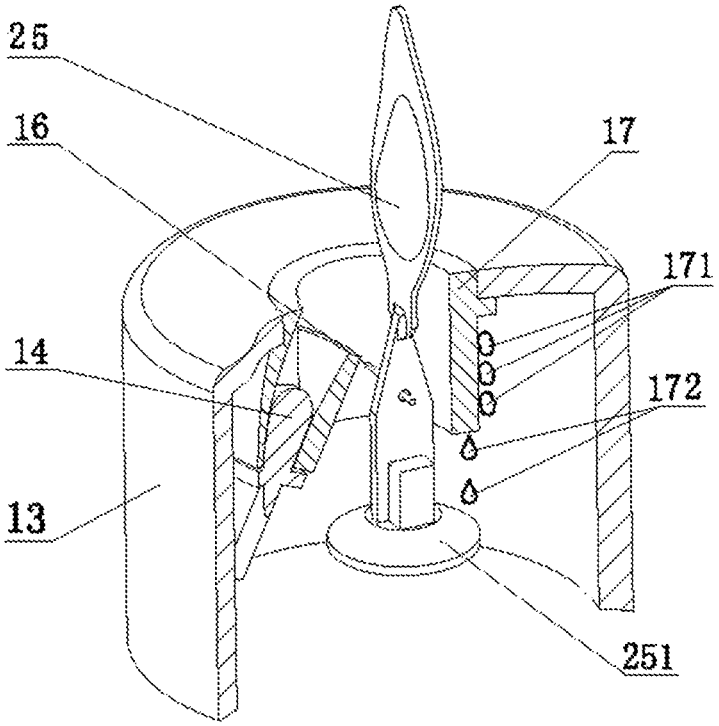
FIG. 5 shows a second preferred embodiment of the invention, a method and device of enabling the flame of an electric candle to have dynamic visual effect, which is a local sectional and working state diagram of the electric candle device comprising a second candle flame simulating object 25.
Figure 6:
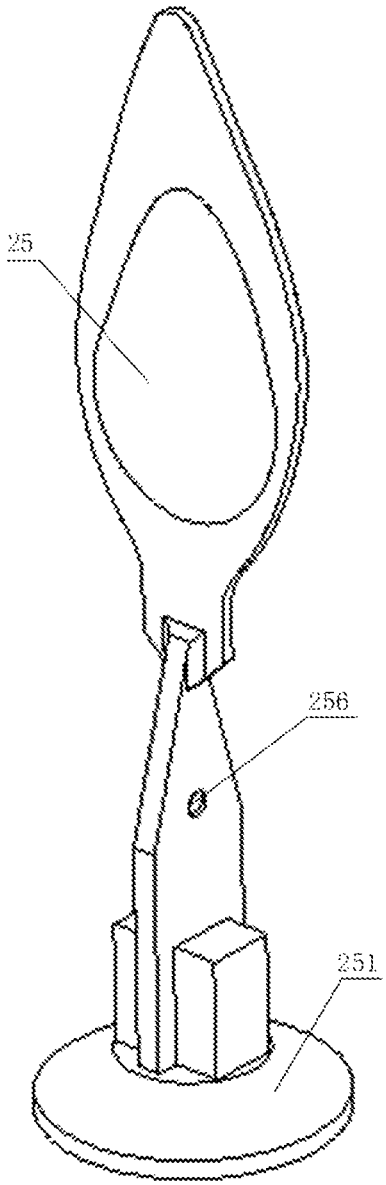
FIG. 6 shows an axonometric projection diagram of the second candle flame simulating object 25 of the second preferred embodiment.

FIG. 5 shows the second preferred embodiment of the invention, which is a local sectional and working state diagram of the electric candle device comprising a second candle flame simulating object 25. The water stirring device 18 or an external water piping can be applied to enable inside of the shell 11 of the electric candle to produce water beads, which may attach to the outer cylindrical surface of the holder 17. The water beads 171 may slide down along the outer cylindrical surface to form water drops 172. Water drops 172 may flow down continuously onto the platform 251 of the second candle flame simulating object 25, enabling the second candle flame simulating object 25 to swing back and forth surrounding the pivot 16, resulting in the visual effect of a dynamic flame.

Figure 7:
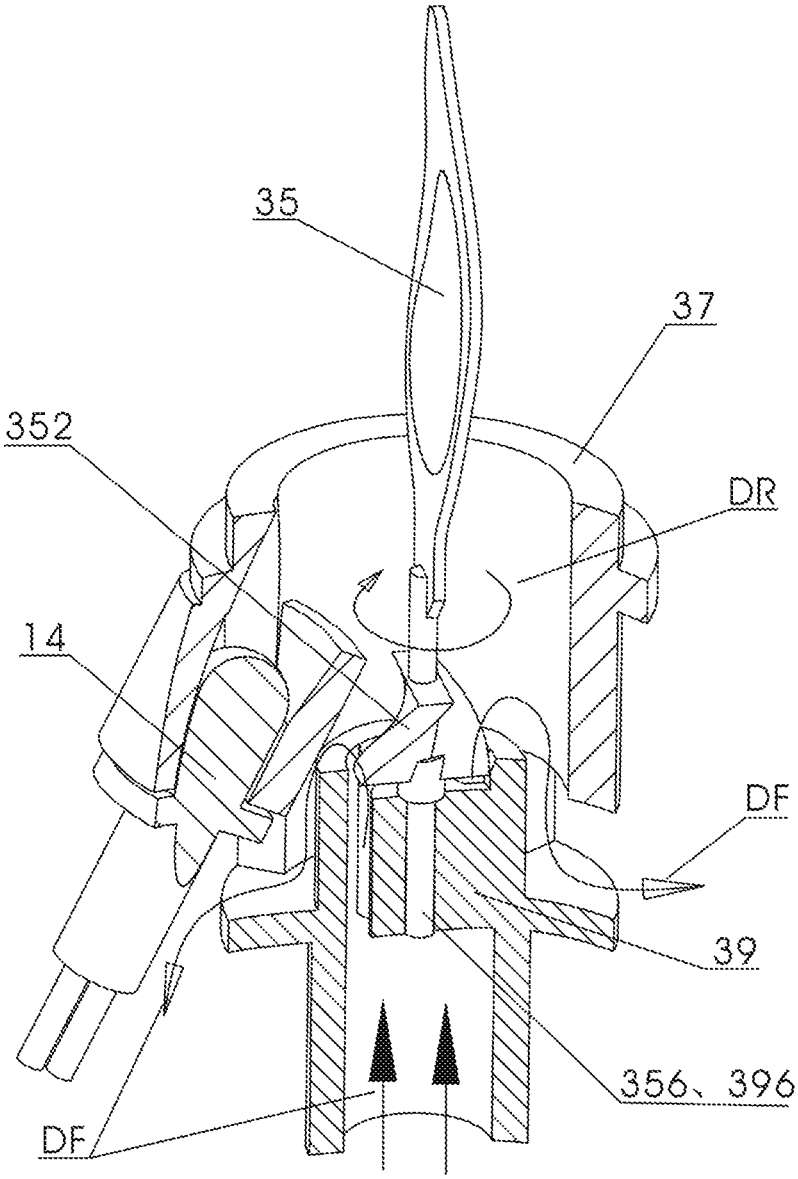
FIG. 7 shows a third preferred embodiment of the invention, a method and device of enabling the flame of an electric candle to have dynamic visual effect, which is a local sectional and working state diagram of the electric candle device comprising a third candle flame simulating object 35.
Figure 8:
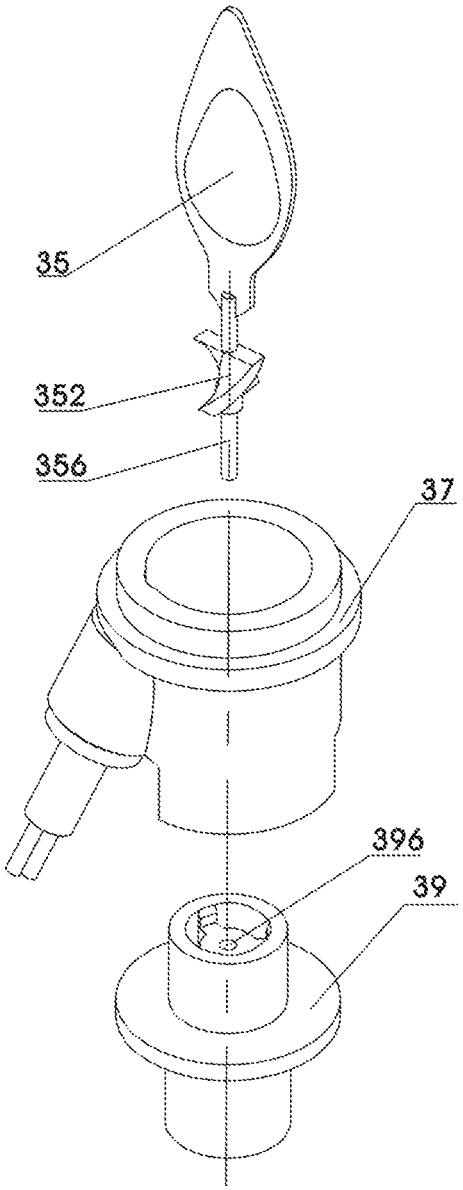
FIG. 8 shows a coaxial decomposition diagram of the electric candle device of the third embodiment.

Referring to FIG. 7 and FIG. 8, the third embodiment of the invention, a method of enabling the flame of an electric candle to have dynamic visual effect, comprising the following steps:

A. installing a removable upper cover 13 on at least one cylindrical shell 11 with only one open end and with a tubular mounting rack (37) fixed at a central part of the upper cover 13, the mounting rack 37 for mounting a candle flame simulating object; a third candle flame simulating object 35 is axially and rotatably mounted onto the mounting rack 37 by aid of a central through hole 396 of a supporting seat 39 arranged under the mounting rack 37, the supporting seat for supporting the third candle flame simulating object;

B. enabling the third candle flame simulating object 35 to pass through the central through hole of the upper cover 13, and extending the head part of the third candle flame simulating object to outside of the upper cover 13;

C. installing a Light Emitting Diode lamp 14 on a vertical wall of the mounting rack (37) and located at the lower front of one lateral plane of the head part of the third candle flame simulating object (35), enabling the light thereof to upwardly and obliquely emit onto the lateral plane of the head part of the third candle flame simulating object 35 by an elevation angle β;

D. installing an impeller 352 in a shape of a water turbine rotor or an impeller comprising an assembly of multiple inclined plates coaxially at the lower part of the third candle flame simulating object 35, inserting a shaft provided at a tail part 356 of the impeller 352 into the central through hole 396 of the supporting seat 39;

E. filling water into the shell 11, and arranging a submersible pump inside the shell, or introducing water from outside to axially gush upward from under a second central through hole of the supporting seat 39 wherein the second central through hole has a larger diameter than the first central though hole of the supporting seat 39, and then discharging water through a discharging channel at a lateral side of the impeller;

starting the submersible pump or opening a valve introducing water from outside; the water flow impacts the impeller 352 from bottom up axially, enabling the third candle flame simulating object 35 to rotate; the Light Emitting Diode light is projected to the head part of the third candle flame simulating object 35, resulting in the visual effect of a dynamic flame.

The third embodiment of the invention further relates to an electric candle device capable of realizing visual effect of a dynamic flame, the electric candle device comprising a shell 11, an upper cover 13 and at least one third candle flame simulating object 35. The shell 11 has only one open end with an upper cover 13 installed thereupon; the third candle flame simulating object 35 passes through a central through hole of the upper cover 13, the head part of the third candle flame simulating object 35 extending out of the upper cover 13. The electric candle device further comprises a Light Emitting Diode lamp 14, a mounting rack 37 for mounting the third candle flame simulating object, and a supporting seat 39 coaxially installed to the lower part of the mounting rack 37, the supporting seat 39 for supporting the third candle flame simulating object; the mounting rack 37 is tubular and is fixed to a central part of the upper cover 13; the third candle flame simulating object 35 is axially and rotatably mounted onto the mounting rack 37 through the central through hole 396 of the supporting seat 39 under the mounting rack 37; the central through hole 396 is a through hole with an axial length equal to that of superior large segment of the supporting seat 39 installed coaxially under the mounting rack 37; the tail shaft end 356 of the third candle flame simulating object 35 is inserted into the through hole and prevented from making a horizontal displacement; meanwhile the third candle flame simulating object 35 may be assured to rotate stably with an erect posture.

The Light Emitting Diode lamp 14 is installed on a vertical wall of the mounting rack 37 and located at the lower front of one lateral plane of the head part of the third candle flame simulating object 35, such that the light thereof upwardly and obliquely emits onto said lateral plane of the head part of the third candle flame simulating object 35 by an elevation angle β.

A submersible pump is arranged at the lower part of the shell 11 and is filled with water inside. Water from outside can axially gush upward from under a second central through hole of supporting seat 39 wherein the second central through hole has a larger diameter than the first central through hole of the supporting seat (39); water may be discharged from a discharging hole at the lateral side of the impeller 352.

The elevation angle of the light emitted from the Light Emitting Diode lamp 14 may be within the range of $20° \leq \beta \leq 70°$. A head part of the third candle flame simulating object is flat having a flame-like form, and it may be made of translucent material; an impeller 352 in a shape of a water turbine rotor or an impeller comprising an assembly of multiple inclined plates is coaxially installed in the lower part of the third candle flame simulating object 35, wherein a shaft provided at the tail part 356 of the impeller 352 is inserted into the axial central through hole 396 of the candle flame simulating object supporting seat 39.

What is claimed is:

1. An electric candle device capable of realizing visual effect of a dynamic flame, said electric candle comprising a shell, an upper cover and at least one candle flame simulating objects, wherein the shell has only one open end with an upper cover installed thereupon, the candle flame simulating object passing through a central through hole of the upper cover with a head part of the candle flame simulating object extending to outside of the upper cover;

wherein the electric candle device further comprises a Light Emitting Diode lamp, a pivot, a holder for holding the candle flame simulating object and a water stirring device; wherein the holder is tubular and is fixed to a central part of the upper cover, the candle flame simulating object is vertically positioned in the holder in a swinging mode by aid of the pivot;

wherein the Light Emitting Diode lamp is installed on a vertical wall of the holder and located at the lower front of one lateral plane of the head part of the candle flame simulating object such that light of the Light Emitting Diode lamp upwardly and obliquely emits onto said lateral plane of the head part of the candle flame simulating object by an elevation angle β; wherein the water stirring device is arranged at a lower part of the shell, the shell can store water to immerse a tail end of the candle flame simulating object.

2. The electric candle device according to claim 1, wherein the elevation angle β of the light emitted from the Light Emitting Diode lamp is within a range of $20° \leq \beta \leq 70°$.

3. The electric candle device according to claim 1, wherein the candle flame simulating object is flat, with the head part thereof having a flame-like form; wherein a lower part of the candle flame simulating object is thicker than an upper part thereof; wherein a through hole is provided in the middle of the candle flame simulating object, the through hole being penetrated by the pivot; wherein the candle flame simulating object can be in an upright position and can swing due to the lower part thereof being heavier than the upper part thereof.

4. The electric candle device according to claim 1, wherein the candle flame simulating object has a flame-shaped flat head wherein the candle flame simulating object is made of translucent material.

5. The electric candle device according to claim 1, wherein the water stirring device is a water pump, an air pump, an ultrasonic nebulizer, or a wave maker.

6. An electric candle device capable of realizing visual effect of a dynamic flame, comprising a shell, an upper cover and at least one candle flame simulating object; wherein the shell has only one open end with the upper cover installed thereupon, the candle flame simulating object passing through a central through hole of the upper cover, with a head part of the candle flame simulating object extending to outside of the upper cover;

wherein the electric handle device further comprises a Light Emitting Diode lamp, a mounting rack for mounting the candle flame simulating object, and a supporting seat coaxially installed to a lower part of the mounting rack, the supporting seat for supporting the candle flame simulating object; the mounting rack is tubular and is fixed to a central part of the upper cover; the candle flame simulating object is axially and rotatably mounted onto the mounting rack through a first central through hole of the supporting seat placed under the mounting rack;

wherein the Light Emitting Diode lamp is installed on a vertical wall of the mounting rack and located at the lower front of one lateral plane of the head part of the third candle flame simulating object, such that the light thereof upwardly and obliquely emits onto said lateral plane of the head part of the candle flame simulating object by an elevation angle β;

wherein a submersible pump is arranged at the lower part of the shell which can be filled with water; or wherein the electric candle device is configured to allow water to be introduced from outside to axially gush upward from under a second central through hole of the supporting seat wherein the second central through hole has a larger diameter than the first central through hole of the supporting seat, and the electric candle device is configured to discharge the water from a discharging hole at a lateral side of the candle flame simulating object.

7. The electric candle device according to claim 6, wherein the elevation angle β of the light emitted from the Light Emitting Diode lamp is within a range of $20° \leq \beta \leq 70°$.

8. The electric candle device according to claim 6, wherein a head part of the candle flame mimic is flat and having a flame-like form; an impeller in a shape of a water turbine rotor or an impeller comprising an assembly of multiple inclined plates is coaxially installed in the lower part of the candle flame simulating object, wherein a shaft provided at a tail part of the impeller is inserted into the supporting seat.

9. The electric candle device according to claim 6, wherein the candle flame simulating object has a flame-shaped flat head and is made of translucent material.

10. An electric candle device capable of realizing visual effect of a dynamic flame, said electric candle comprising a shell, an upper cover and at least one candle flame simulating object, wherein the shell has only one open end with an upper cover installed thereupon, the candle flame simulating object passing through a central through hole of the upper cover with a head part of the candle flame simulating object extending to outside of the upper cover;

wherein the electric candle device further comprises a Light Emitting Diode lamp, a pivot, a holder for holding the candle flame simulating object and a water stirring device; wherein the holder is tubular and is fixed to a central part of the upper cover, the candle flame simulating object is vertically positioned in the holder in a swinging mode by aid of the pivot;

wherein the LED lamp is installed on a vertical wall of the holder and located at the lower front of one lateral plane of the head part of the candle flame simulating object such that light of the LED lamp upwardly and obliquely emits onto said lateral plane of the head part of the candle flame simulating object by an elevation angle β;

wherein a tail end of the candle flame simulating object is connected to a horizontally positioned bottom platform coaxially and orthogonally;

wherein a water stirring device is provided at or an external water piping is introduced to the lower part of the shell; the water stirring device capable of continuously providing a plurality of water drops onto the bottom platform so as to enable the candle flame simulating object to swing back and forth surrounding the pivot.

11. The electric candle device according to claim 10, wherein:

the elevation angle β of the light emitted from the LED lamp is within a range of $20° \leq \beta \leq 70°$.

12. The electric candle device according to claim 10, wherein the candle flame simulating object is flat, with the head part thereof having a flame-like form; wherein a lower part of the candle flame simulating object is thicker than an upper part of the candle flame simulating object; wherein a through hole is provided in the middle of the candle flame simulating object, the through hole being penetrated by the pivot; wherein the candle flame simulating object can be in an upright position and can swing due to the lower part thereof being heavier than the upper part thereof.

13. The electric candle device according to claim 10, wherein:

the candle flame simulating object has a flame-shaped flat head wherein the candle flame simulating object is made of translucent material.

14. The electric candle device according to claim 10, wherein:

the lower part of the candle flame simulating object is coaxially and orthogonally connected to a horizontally positioned platform.

* * * * *